US008308914B2

(12) United States Patent
Hsu

(10) Patent No.: US 8,308,914 B2
(45) Date of Patent: Nov. 13, 2012

(54) ELECTROLYTIC OZONE CELL ANODE SPRING BOARD FIXTURE STRUCTURE

(76) Inventor: Mingyung Hsu, Shandong (CN)

( * ) Notice: Subject to any disclaimer, the term of this patent is extended or adjusted under 35 U.S.C. 154(b) by 166 days.

(21) Appl. No.: 12/990,840

(22) PCT Filed: Mar. 6, 2009

(86) PCT No.: PCT/CN2009/072117

§ 371 (c)(1),
(2), (4) Date: Dec. 4, 2010

(87) PCT Pub. No.: WO2009/146653

PCT Pub. Date: Dec. 10, 2009

(65) Prior Publication Data

US 2011/0073467 A1 Mar. 31, 2011

(30) Foreign Application Priority Data

Jun. 4, 2008 (CN) ..... 2008 1 0016559

(51) Int. Cl.

| | |
|---|---|
| ***C01B 13/10*** | (2006.01) |
| ***C01B 13/11*** | (2006.01) |
| ***C25B 9/02*** | (2006.01) |
| ***C25B 11/02*** | (2006.01) |
| ***C25B 11/03*** | (2006.01) |
| ***C25B 11/04*** | (2006.01) |
| ***C25B 11/16*** | (2006.01) |

(52) U.S. Cl. ..... 204/176; 204/164; 204/286.1; 204/288.3; 204/297.14; 204/297.01; 204/284; 204/280; 422/186.07; 422/186.13

(58) Field of Classification Search ..... 422/186.07, 422/186.13; 205/626; 204/164, 176, 280, 204/284, 286.1, 288.3, 297.01, 297.14
See application file for complete search history.

(56) References Cited

U.S. PATENT DOCUMENTS

| | | | | |
|---|---|---|---|---|
| 5,354,541 | A * | 10/1994 | Sali et al. | 422/186.07 |
| 7,449,090 | B2 * | 11/2008 | Andrews et al. | 204/225 |
| 2009/0071838 | A1 * | 3/2009 | Murphy et al. | 204/225 |

* cited by examiner

*Primary Examiner* — Bruce Bell
(74) *Attorney, Agent, or Firm* — Chun-Ming Shih

(57) ABSTRACT

An electrolytic ozone cell anode spring fastening board structure includes a solid polymer electrolyte membrane (1), an anode electrocatalyst layer (2), a diffusion layer (3), frame body and support parts (5). A diffusion layer counterpiece (4) has one side attached to the diffusion layer (3), the other side of the diffusion layer counterpiece (4) equipped with a centered elevated step, which contacts the center of the convex side of a spherical spring board (6). In addition, the solid polymer electrolyte membrane (1), frame body and support parts (5), diffusion layer (3), diffusion layer counterpiece (4) and spring board (6) are held together by mechanical fastening means. It prevents a decrease in ozone generation rate in electrolytic ozone cell that can occur from the metal board deformation and thinning of the anode electrocatalyst layer. This will enable the cell to maintain stable fasten strength and good contact of the metal board and anode catalyst in long term operation, achieving stable electrolytic ozone generation rate and cell performance.

8 Claims, 2 Drawing Sheets

ELECTROLYTIC OZONE CELL ANODE SPRING BOARD FIXTURE STRUCTURE

BACKGROUND OF THE INVENTION

1. Technical Field

This invention relates generally to an electrolytic ozone cell technology that uses pure water as the raw source. More particularly, it relates to an electrolytic ozone cell anode spring board fixture structure.

2. Related Art

There are a variety of structures for the anode electrode of the electrolytic ozone cells that use pure water as the source. Most existing technologies use PTFE to bond the anode electrocatalyst particles to form the anode electrocatalyst membrane. Apart from this, there are also coating, plating, and pressing methods for attaching anode electrocatalyst particles. Regardless of the type of anode electrocatalyst layer formation technology used for particle attachment, the fundamental use of the metal plate (flat structure) pressing board remains in the process. The metal plate supplies pressure to the anode electrocatalyst and the solid polymer electrolyte membrane for firm contact through fastening. However, the metal plate pressing board has the following drawbacks:

1. In the fastening process, a metal plate subjected to long term stress will result in metal plastic deformation. Increasing the thicknesses of the metal plate or metal plate reinforcement structure does not avoid the prolonged effect of the fastening stress, and the plate deformation will increase over time. This will cause compression force between the anode electrocatalyst layer and the solid polymer electrolyte membrane to reduce, and the electrolytic ozone cell ozone generation rate will decrease.

2. Increasing the thicknesses of the metal plate or metal plate reinforcement structure in order to increase the in-plane strength not only adds production costs and complexities, but regardless of any increase in in-plane strength, deformation of the metal plate is unavoidable.

3. Over long term use, the thickness of the anode electrocatalyst layer will gradually become thinner. With this thinning, the metal plate cannot continue to provide enough pressure, directly causing the electrolytic ozone cell anode electrode structure contact to loosen, resulting in insufficient compression of the anode electroatalyst layer and solid polymer electrolyte membrane, lowering the electrolytic ozone cell ozone generation rate.

SUMMARY

This invention overcomes the drawbacks of existing technology described above and provides a type of electrolytic ozone cell anode spring board fastening structure to assure that not only a reduction in pressing strength between the anode electrocatalyst layer and solid polymer electrolyte membrane caused by deformations of the metal material plate can be avoided, but also with thinning of the anode electrocatalyst layer, the required pressure can be maintained. After long periods of operation, the fastening stress to the anode structure of the electrolytic ozone cell remains constant for reliable cell performance and stable ozone production.

The invention can be achieved through the following approaches: a type of electrolytic ozone cell anode spring board fastening structure, which includes a solid polymer electrolyte membrane, anode electocatalyst layer, diffusion layer, frame body and support parts, the anode electrocatalyst layer placed between the solid polymer electrolyte membrane and diffusion layer; the frame body and support parts surround the edge of the anode electrocatalyst layer and diffusion layer, wherein one side of the diffusion layer counterpiece is attached to diffusion layer, the other side of the diffusion layer counterpiece is equipped with a centered elevated step, which contacts the center of the convex side of the spherical spring board. In addition, the solid polymer electrolyte membrane, frame body and support parts, diffusion layer, diffusion layer counterpiece and spring board are held together by mechanical fastening means.

In order to accomplish this invention, there is a support plate on the spring board. In order to accomplish this invention, the above mentioned support plate is of dense metal material.

In order to accomplish this invention, the above mentioned spring board is of flexible metal material.

In order to accomplish this invention, the above mentioned anode electrocatalyst layer film is of lead dioxide.

In order to accomplish this invention, the above mentioned frame body is of flexible perfluoro elastomer.

In order to accomplish this invention, the above mentioned diffusion layer is a porous titanium plate.

This invention compared with existing technologies has the following significant advantages:

1. Since this invention employs a spring board and the electrolytic ozone cell requires this to produce elastic pressure, when anode structure of the electrolytic ozone cell is fastened as a whole, over long term operation will not result in deformation and cause the anode electrocatalyst layer structure contact to loosen, decreasing the ozone generation rate.

2. The electrolytic ozone cell anode fastening structure as a whole, with the center of the spring board and surrounding diffusion layer counterpiece and frame body and other supporting parts exert two forces.

When the anode structure of the electrolytic ozone generator is fastened as a whole, the center of the spring board and the surrounding part are subject to two stresses given by the diffusion layer counterpiece and frame body and other support parts. Since the surrounding frame body and other support parts are flexible structures which can be compressed, whereas, the center structure cannot, the fastened spring board will have a certain extent of deformation within its elasticity range. When used for a period of time the reduction of pressure on the anode electrocatalyst layer due to the deformation of the metal plate pressing board can be quickly compensated. Therefore, the electrolytic ozone cell is able to maintain stable performance.

DRAWING DESCRIPTION

DETAILS OF THE INVENTION

IMPLEMENTATION EXAMPLE 1

Figure 1:
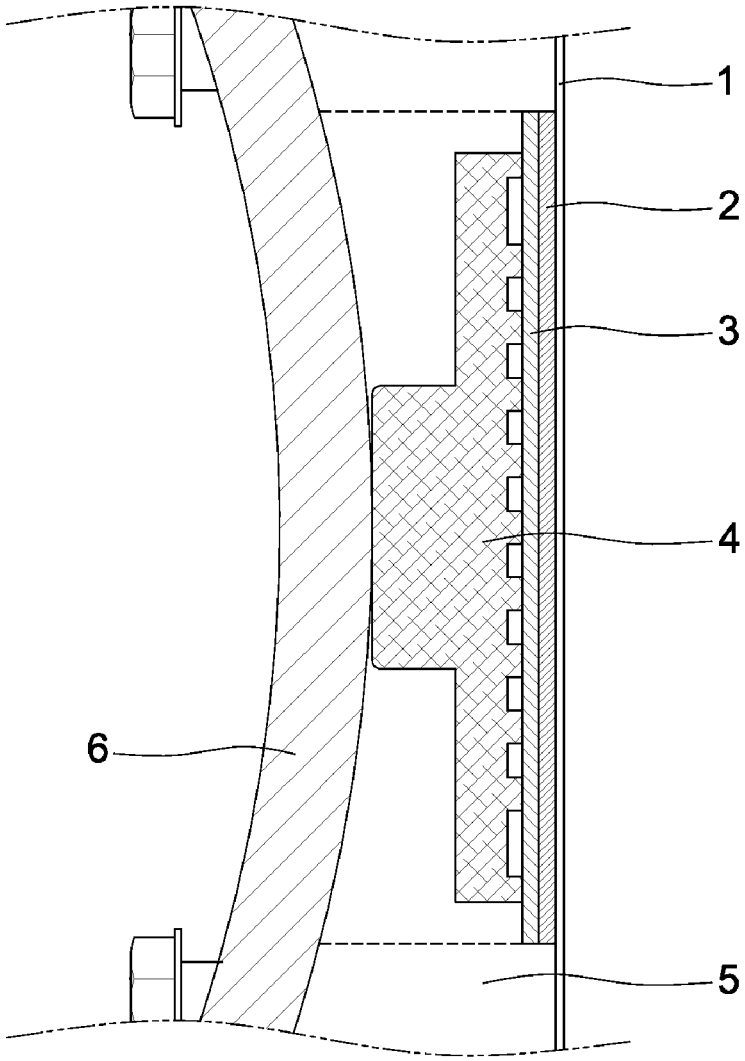
FIG. 1 is the cross-sectional diagram of the implementation of this invention.
Figure 2:
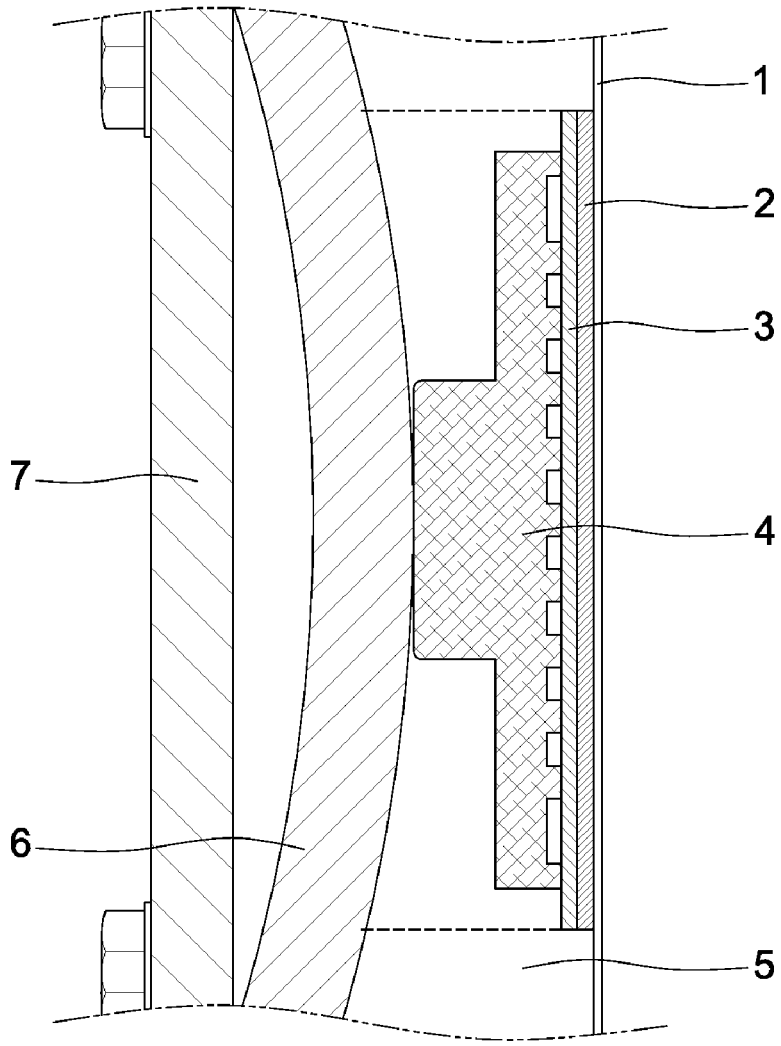
FIG. 2 is the alternate cross-sectional diagram of the implementation of this invention.

An electrolytic ozone cell anode spring board fastening structure (see FIG. 1). The Anode Electrocatalyst Layer (2), with thickness of 0.1~5 mm, is placed on the solid polymer electrolyte membrane (1) (DuPont Naflon117), opposite the side of cathode structure of electrolytic ozone cell. The anode electrocatalyst layer (2) is of lead dioxide film layer. Various methods to create this layer include are as follows:

1. Spreading and placing the anode electrocatalyst particles on the solid polymer electrolyte membrane (1) with freedom flat stacking.

2. Using PTFE to bind the catalyst particles, creating the anode electrocatalyst membrane film.

3. Applying other methods to enable lead dioxide to attach onto the surface of solid polymer electrolyte membrane (1).

Then, the diffusion layer (3) (the surface of the diffusion layer is treated to create a conductive, corrosion-resistant, protection layer) is placed on the anode electrocatalyst layer (2). The diffusion layer (3) is a porous titanium plate, with aperture ranging 10~500 μm. The frame body and the support parts (5) surround the edge of the anode electrocatalyst layer (2) and the diffusion layer (3) for sealing. The diffusion layer counterpiece (4) is placed on the diffusion layer (3). One side of the diffusion layer counterpiece (4) closely contacts the diffusion layer (3). The other side, with a centered elevated step design, contacts the center of the convex side of the spherical spring board (6), with a difference in curve depth range of 0.1~2.5 mm.

In order to fasten and hold together the entire electrolytic ozone cell anode fastening structure, mechanical fastening method is applied. The solid polymer electrolyte membrane (1), frame body and support parts (5), diffusion layer (3), diffusion layer counterpiece (4), and spring board (6) are fastened as a whole. Through the mechanical fastening, a displacement due to elastic deformation present in the surrounding part of the spring board (6) exerts pressure on the frame body and support parts (5). The pressure, exerted on the frame body and support parts (5), enables the surrounding part of the anode structure to be pressed and firmly contacts the solid polymer electrolyte membrane (1), and seals the interior space of the anode structure. In addition, the stress that arises as a result of mechanical fastening of the spherical structure of the spring board (6) to its surrounding part can be transfer to its center. this presses the diffusion layer counterpiece (4), diffusion layer (3) and anode electrocatalyst layer (2) together to firmly attach to the solid polymer electrolyte membrane (1). Given the distance with respects to the boundary of the surrounding parts is constant and defined by the mechanical fastening techniques, the elastic pressure of the spring board (6) at the spherical center remains constant. degrees of deformation of the pressing spring board (6) range between 0.1 and 2.5 mm.

IMPLEMENTATION EXAMPLE 2

An electrolytic ozone cell anode spring board fastening structure (see FIG. 1). The Anode electrocatalyst layer (2), with thickness of 0.1~5 mm, is placed on the solid polymer electrolyte membrane (1) (DuPont Naflon117), opposite the side of cathode structure of electrolytic ozone cell. The anode electrocatalyst layer (2) is of lead dioxide film layer. Various methods to create this layer are as follows:

1. Spreading and place the anode electrocatalyst particles on the solid polymer electrolyte membrane (1) with freedom flat stacking.

2. Using PTFE to bind the catalyst particles, creating the anode electrocatalyst membrane film.

3. Applying other methods to enable lead dioxide to attach onto the surface of solid polymer electrolyte membrane(1).

Then, the diffusion layer (3) (the surface of the diffusion layer is treated to create a conductive, corrosion-resistant, protection layer) is placed on the anode electrocatalyst layer (2). The diffusion layer (3) is a porous titanium plate, with aperture ranging 10~500 μm. The frame body and the support parts (5) surround the edge of the anode electrocatalyst layer (2) and the diffusion layer (3) for sealing. the diffusion layer counterpiece (4) is placed on the diffusion layer (3). One side of the diffusion layer counterpiece (4) closely contacts the diffusion layer (3). The other side, with a centered elevated step design, contacts the center of the convex side of the spherical spring board (6),with a difference in curve depth range of 0.1~2.5 mm.

A support plate (7) is pressed to lock on the spring board (6). This is to ensure uniform distribution of pressure over the entire Spring Board.

In order to fasten and hold together the entire electrolytic ozone cell anode fastening structure, mechanical fastening method is applied. The solid polymer electrolyte membrane (1), frame body and support parts (5), diffusion layer (3), diffusion layer counterpiece (4), and spring board (6) are fastened as a whole. Through the mechanical fastening, a displacement due to elastic deformation present in the surrounding part of the spring board (6) exerts pressure on the frame body and support parts (5). The pressure, exerted on the frame body and support parts (5), enables the surrounding part of the anode structure to be pressed and firmly contacts the solid polymer electrolyte membrane (1), and seals the interior space of the anode structure. In addition, the stress that arises as a result of mechanical fastening of the spherical structure of the spring board (6) to its surrounding part can be transfer to its center. This presses the diffusion layer counterpiece (4), diffusion layer (3) and anode electrocatalyst layer (2) together to firmly attach to the solid polymer electrolyte membrane (1). Given the distance with respects to the boundary of the surrounding parts is constant and defined by the mechanical fastening techniques, the elastic pressure of the spring board (6) at the spherical center remains constant degrees of deformation of the pressing spring board (6) range between 0.1 and 2.5 mm.

I claim:

1. An anode spring board fastening structure of an electrolytic ozone cell, comprising:

a solid polymer electrolyte membrane (1), an anode electrocatalyst layer (2), a diffusion layer (3), and frame body and support parts (5), wherein the anode electrocatalyst layer (2) is between the solid polymer electrolyte membrane (1) and the diffusion layer (3), and the frame body and support parts (5) surround the anode electrocatalyst layer (2) and the diffusion layer (3); and a diffusion layer counterpiece (4), with one side attached to the diffusion layer (3), and the other side contacting the center of the convex side of a spherical spring Board (6);

wherein, the solid polymer electrolyte membrane (1), the frame body and support parts (5), the diffusion layer (3), the diffusion layer counterpiece (4) and the spring board (6) are held together by mechanical fastening means.

2. The structure of claim 1, wherein the support plate (7) is located on the spring board (6).

3. The structure of claim 2, wherein the support plate (7) is a pressing board made of dense metal material.

4. The structure of claims 1, wherein the spring board (6) is of flexible metal material.

5. The structure of claim 1, wherein the anode electrocatalyst layer (2) is of lead dioxide film layer.

6. The structure of claim 1, wherein the frame body is of flexible perfluoro elastomer.

7. The structure of claim 1, wherein the diffusion layer (3) is a porous titanium plate.

8. The structure of claim 1, wherein the other side of the diffusion layer counterpiece (4) is equipped with a centered elevated step design, which contact the center of the convex side of the spherical spring board (6).

* * * * *